US010669884B2

(12) United States Patent
Pecchioli et al.

(10) Patent No.: US 10,669,884 B2
(45) Date of Patent: Jun. 2, 2020

(54) WASHING NOZZLES AND GAS TURBINE ENGINES

(71) Applicant: Nuovo Pignone Srl, Florence (IT)

(72) Inventors: Mario Pecchioli, Florence (IT); Celia Navarro-Canales, Queretaro (MX); Jorge Omar Manon-Cantu, Queretaro (MX); Tommaso Olivieri, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 294 days.

(21) Appl. No.: 15/102,071

(22) PCT Filed: Dec. 4, 2014

(86) PCT No.: PCT/EP2014/076563
§ 371 (c)(1),
(2) Date: Jun. 6, 2016

(87) PCT Pub. No.: WO2015/082610
PCT Pub. Date: Jun. 11, 2015

(65) Prior Publication Data

US 2016/0305277 A1 Oct. 20, 2016

(30) Foreign Application Priority Data

Dec. 6, 2013 (IT) ..... CO2013A0064

(51) Int. Cl.
*B05B 1/04* (2006.01)
*B08B 3/08* (2006.01)
(Continued)

(52) U.S. Cl.
CPC ..... *F01D 25/002* (2013.01); *B05B 1/046* (2013.01); *B08B 3/08* (2013.01); *B08B 9/093* (2013.01);
(Continued)

(58) Field of Classification Search
CPC .... F01D 25/002; F01D 25/007; F04D 29/701; F04D 29/705; B08B 9/093; B08B 9/0813; B08B 3/08; B05B 1/046
See application file for complete search history.

(56) References Cited

U.S. PATENT DOCUMENTS 2,997,244 A * 8/1961 Jules ..... B05B 1/046 239/532
3,782,641 A * 1/1974 Springer ..... B05B 1/046 239/598
(Continued)

FOREIGN PATENT DOCUMENTS

CN 1705524 A 12/2005
CN 1908383 A 2/2007
(Continued)

OTHER PUBLICATIONS

Pecchioli, M., et al., Methods of washing gas turbine engines and gas turbine engines, GE co-pending Application No. ITMI2013A002042, filed on Dec. 6, 2013.
(Continued)

*Primary Examiner* — Ninh H. Nguyen
*Assistant Examiner* — Brian P Wolcott
(74) *Attorney, Agent, or Firm* — Baker Hughes Patent Organization

(57) ABSTRACT

Nozzle used for spraying a liquid substance towards a compressor of a gas turbine engine, comprising an elongated body having an end for ejecting the liquid substance, a conduit for the liquid substance internal to the elongated body and extending up to the end, a recess located at the end, wherein the conduit ends in the recess; wherein the recess opens towards the lateral surface of the elongated body, typically a cylindrical body, and the conduit is tangential to the bottom of the recess.

13 Claims, 3 Drawing Sheets

(51) Int. Cl.

| | |
|---|---|
| ***B08B 9/093*** | (2006.01) |
| ***F01D 25/00*** | (2006.01) |
| ***F04D 29/32*** | (2006.01) |
| ***F04D 29/52*** | (2006.01) |

(52) U.S. Cl.
CPC ..... *F04D 29/321* (2013.01); *F04D 29/522* (2013.01); *F05D 2220/32* (2013.01); *F05D 2250/291* (2013.01)

(56) References Cited

U.S. PATENT DOCUMENTS

| | | | | |
|---|---|---|---|---|
| 5,011,540 | A | 4/1991 | McDermott | |
| 5,273,395 | A * | 12/1993 | McDermott | B08B 3/02 134/199 |
| 5,944,483 | A * | 8/1999 | Beck | F01D 25/002 134/104.1 |
| 8,028,936 | B2 * | 10/2011 | McDermott | B05B 1/14 239/463 |
| 8,216,392 | B2 | 7/2012 | Giljohann et al. | |
| 9,492,906 | B2 * | 11/2016 | Rosing | B08B 7/0021 |
| 2007/0000528 | A1 | 1/2007 | Asplund et al. | |
| 2007/0028947 | A1 | 2/2007 | Erickson et al. | |
| 2008/0087300 | A1 | 4/2008 | Kohler et al. | |
| 2010/0206966 | A1 | 8/2010 | McDermott | |
| 2013/0174869 | A1 | 7/2013 | Roesing et al. | |

FOREIGN PATENT DOCUMENTS

| | | | | |
|---|---|---|---|---|
| CN | 100478088 | C | 4/2009 | |
| EP | 0781897 | A2 | 7/1997 | |
| EP | 0275987 | A2 | 7/1998 | |
| EP | 1970133 | A1 | 9/2008 | |
| EP | 2286933 | A1 | 2/2011 | |
| EP | 2562430 | A1 | 2/2013 | |
| EP | 2565391 | A1 | 3/2013 | |
| FR | 2614558 | A1 * | 11/1988 | B05B 1/046 |
| GB | 2122920 | A * | 1/1984 | B05B 1/046 |
| GB | 2484337 | A | 4/2012 | |
| JP | H05-317755 | A | 12/1993 | |
| JP | H10-034024 | A | 2/1998 | |
| RU | 2 348 823 | C2 | 3/2009 | |
| RU | 2 615 618 | C1 | 4/2017 | |
| WO | 2011089155 | A2 | 7/2011 | |

OTHER PUBLICATIONS

First Office Action and Search issued in connection with corresponding CN Application No. 201480066752.6 dated Apr. 21, 2017.
Italian Search Report and Written Opinion issued in connection with corresponding Application No. ITCO20130064, dated Mar. 28, 2014.
Italian Search Report and Written Opinion issued in connection with corresponding Application No. MI2013A002042, dated Sep. 15, 2014.
International Search Report and Written Opinion issued in connection with corresponding Application No. PCT/EP2014/076562, dated Feb. 4, 2015.
International Search Report and Written Opinion issued in connection with corresponding Application No. PCT/EP2014/076563, dated Feb. 20, 2015.
Mario Pecchioli, et al, U.S. Appl. No. 15/102,079.
Syverud et al., "Online Water Wash Tests of GE J85-13", Transactions of the ASME, vol. No. 129, pp. 136-142, Jan. 2007.
Unofficial English Translation of Chinese Office Action issued in connection with Related CN Application No. 201480066662.7 dated Mar. 20, 2017.
Decision to Grant issued in connection with corresponding RU Application No. 2016122201 dated May 8, 2018.
Machine Translation and Notification of Reasons for Refusal issued in connection with corresponding JP Application No. 2016-536621 dated Oct. 9, 2018.

* cited by examiner

WASHING NOZZLES AND GAS TURBINE ENGINES

BACKGROUND

Embodiments of the present invention relate to washing nozzles and gas turbine engines.

As it is known, gas turbine engines, in particular their compressors, are affected by fouling and therefore need to be cleaned repeatedly during their lifetime.

A common way to clean a gas turbine engine consists in interrupting its normal operation and washing it, without disassembling the engine. This is the so-called "off-line" washing and is carried out by means of a liquid detergent. After treatment with the liquid detergent, rinsing is often necessary. Off-line washing is very effective; anyway, it implies interrupting normal operation and therefore increases the downtime of the machine and of the plant including the machine.

It is also known, even if less common, to wash a gas turbine engine during operation, i.e. when the engine generates work. This is the so-called "on-line" washing and consists in adding a liquid detergent to the gas flowing in the compressor. In this case, the quantity of liquid detergent added to the gas is small (more precisely the liquid-to-gas ratio is maintained low) and the pressure of the ejected liquid detergent is low in order to avoid: disturbing the operation of the compressor and/or the turbine and/or the combustor (for example the combustion may extinguish due to the liquid detergent), disturbing the fluid flow inside the compressor, damaging the components of the compressor (for example liquid detergent droplets, if any, may hit against e.g. the rotating blades of the compressor).

It is to be noted that liquid detergents use for "off-line" washing are usually different from liquid detergents used for "on-line" washing.

Known on-line washing methods are much less effective then known off-line washing methods, even if they have the advantage of not affecting the downtime of the machine and of the plant including the machine.

BRIEF SUMMARY OF THE INVENTION

Therefore there is a need for an improved way of washing gas turbine engines and for devices allowing it.

It has been conceived to spray a detergent liquid substance towards the inlet of the compressor of the engine; more particularly, the liquid-to-gas ratio at the inlet of the compressor is more than 1% and less than 5% with reference to the rated mass flow of the compressor; and the pressure of the detergent liquid substance to be sprayed is quite high, typically more than 0.2 MPa and less than 2.0 MPa.

A particular design of the spraying nozzles has also been conceived for optimal performances, in particular at the above-mentioned conditions.

A first aspect of the present invention is a nozzle for spraying a liquid substance.

The nozzle is used for spraying a liquid substance towards a compressor of a gas turbine engine, and comprises an elongated body having an end for ejecting the liquid substance, a conduit for the liquid substance internal to the elongated body and extending up to the end, and a recess located at the end, wherein the conduit ends in the recess; wherein the recess opens towards the lateral surface of the elongated body and the conduit is tangential to the bottom of the recess.

A second aspect of the present invention is a gas turbine engine.

The gas turbine engine comprises a compressor, a turbine downstream of the compressor, and a plurality of nozzles for spraying a detergent liquid substance towards the inlet of the compressor; more particularly the nozzles have the features set out above.

BRIEF DESCRIPTION OF DRAWINGS

The accompanying drawings, which are incorporated herein and constitute a part of the specification, illustrate exemplary embodiments of the present invention and, together with the detailed description, explain these embodiments. In the drawings.

DETAILED DESCRIPTION

The following description of exemplary embodiments refers to the accompanying drawings.

The following description does not limit the invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
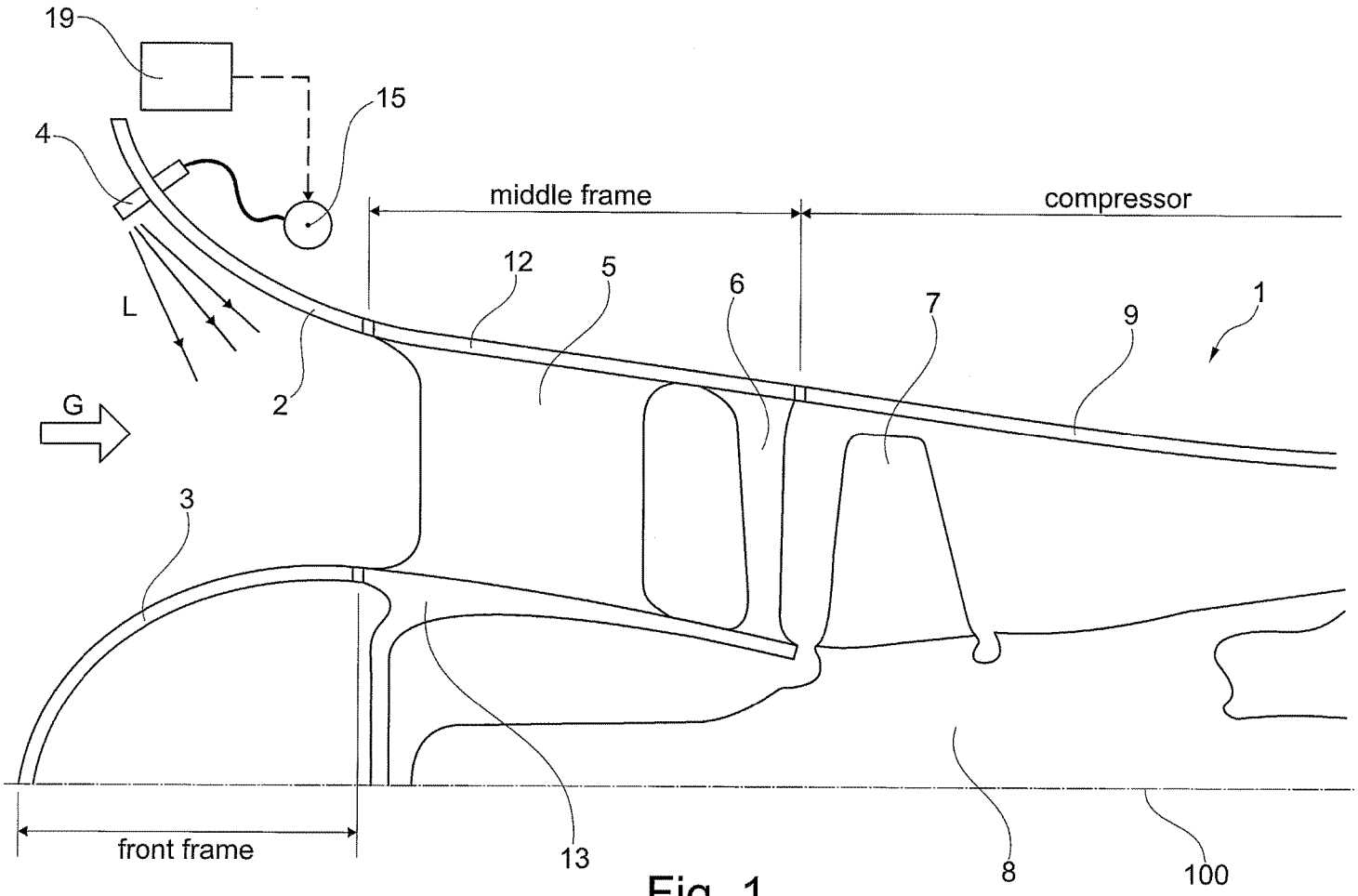
FIG. 1 shows a simplified view of an embodiment of a compressor of a gas turbine engine.

FIG. 1 is a cross-section half view and shows partially an embodiment of a gas turbine engine; in particular, it shows a front frame, including a bell mouth 2 and a bullet nose 3, a (optional) middle frame, including struts 5 and inlet guide vanes 6, and a compressor 1, including a rotor (see references 7 and 8) and a stator (see reference 9). The front frame, in particular the bell mouth 2 and the bullet nose 3, and the middle frame, in particular its outer wall 12 and its inner wall 13, define an inlet path that leads to the inlet of the compressor 1. Just after the inlet of the compressor 1, there is the first rotor stage of the compressor (only one blade 7 is shown). Sometimes, the combination of the front frame, the middle frame and the compressor 1 is called altogether "compressor".

In general, a gas turbine engine comprises the series connection of a compressor (such as the one shown partially in FIG. 1), a combustion chamber with combustion devices (not shown in FIG. 1), and a turbine (not shown in FIG. 1).

In FIG. 1, only few of the components of the rotor and the stator of the compressor 1 are shown; in particular, the shaft 8 of the rotor, one blade 7 of the first stage of the rotor, the casing 9 of the stator; in particular, there are not shown any of the blades of the other stages of the rotor and any of the vanes of the stages of the stator.

In the solution of FIG. 1, there is a plurality of nozzles 4 (only one is shown) for spraying a detergent liquid substance L towards the inlet of the compressor 1.

In this embodiment, the nozzles 4 are located at the mouth 2, i.e. at the smooth converging surface used to direct gas towards the first stage of the compressor, in particular to direct gas G into the inlet path leading to the inlet of compressor 1 through the struts 5 and the inlet guide vanes 6.

Nozzles 4 eject the detergent liquid substance L and atomize it; in this way, the droplets of the liquid L may be entrained by the flow of the gas G (see FIG. 1).

The detergent liquid substance L is sprayed at a certain distance from the external wall (see references 2 and 12) of the inlet path of the compressor 1 and at a certain distance from the internal wall (see references 3 and 13) of the inlet path of the compressor 1 and in a certain direction (see FIG. 1) so to ensure a good and appropriate distribution of the liquid in the gas flow inside the inlet path.

In the embodiment of FIG. 1, the average direction of the liquid substance L is inclined with respect to the average direction of the gas G.

In the embodiment of FIG. 1, the nozzles 4 are located on a circle (centered on the axis 100 of the engine) and at the same distance from each other; in particular, all the nozzles 4 are fluidly connected to a single manifold 15 that is advantageously shaped as a circle (centered on the axis 100 of the engine and located behind the bell mouth 2).

There is also a control unit 19 operatively connected to the manifold 15 so to control the ejection of the detergent liquid substance L; in this way, all the nozzles 4 eject the same quantity of liquid substance at the same time.

An embodiment of a nozzle 4 is shown in FIG. 2 and it may be used for spraying a liquid substance, in particular the detergent liquid substance L in the embodiment of FIG. 1.

Nozzle 4 comprises an elongated cylindrical body 20 having a first end 20-1 for receiving the liquid substance L and a second end 20-4 for ejecting the liquid substance L. There is also a first intermediate part 20-2 and a second intermediate part 20-3; part 20-2 is used for securing the nozzle 4 to the mouth 2; part 20-3 is used for establishing a distance between the ejection point and the external wall (see references 2 and 12) of the inlet path.

A conduit 21 for the flow of the liquid substance L is internal to the elongated cylindrical body 20 and extends from the first end 20-1, through the intermediate parts 20-2 and 20-3, up to the second end 20-4.

A recess 22 is located at the end 20-4, and the conduit 21 ends in the recess 22; when the liquid substance L reaches the recess 22, it is ejected from the recess 22 and sprayed; the level of atomization depends on the pressure upstream the recess 22 and the shape of the recess 22. In order to increase the pressure, the conduit 21 has a certain (relatively large) cross section at its begin portion 21-1, i.e. at the first end 20-1, and smaller cross section at its end portion 21-2, i.e. at the second end 20-4.

Figure 2A:
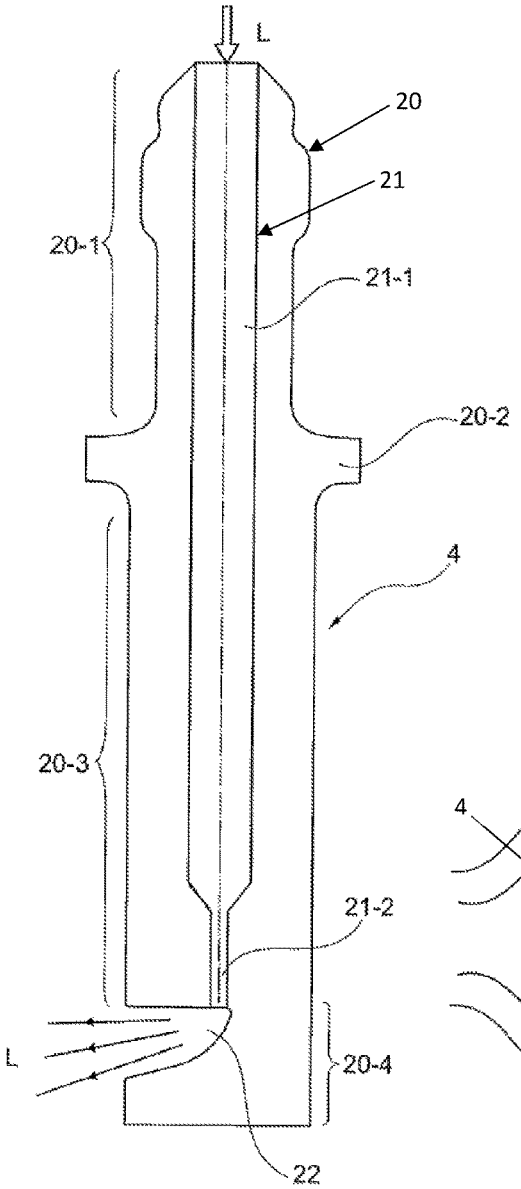
FIG. 2 shows simplified views of an embodiment of a nozzle (FIG. 2A corresponds to a longitudinal cross-section and FIG. 2B corresponds to a transversal cross-section)
Figure 2B:
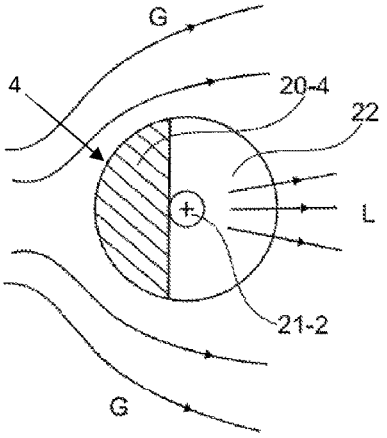

In the embodiment of FIG. 2, the recess 22 is arranged as a diameter of the cylindrical body 20 and opens towards the lateral surface of the cylindrical body 20; in this way, the gas G flows around the cylindrical body 20 (see in particular FIG. 2B) and the liquid L is protected by the cylindrical body 20 (see in particular FIG. 2B); in the embodiment of FIG. 1, the nozzles 4 are located far from where there is a high gas G flow.

In the embodiment of FIG. 2, a good ejection of the liquid substance L is obtained by a conduit 21, specifically its end portion 21-2, tangential to the bottom of the recess 22 (see in particular FIG. 2A); in any a case, the conduit might be substantially tangential to the recess 22, that means at a small axial distance from to the bottom of the recess 22, less than 0.1 mm.

This specific fluid connection between recess 22 and conduit 21 generates a uniform spray of the liquid and a better atomization.

In particular, being the conduit 21 is tangential to the recess 22, the generated liquid droplets have diameters comprise between 150 and 450 μm, more particularly between 250 and 300 μm.

The direction and the aperture of the ejected liquid substance L depend also on the shape of the cross section of the recess 22. In the embodiment of FIG. 2, this shape is partially flat (see portion close to the mouth surface) and partially curved (see FIG. 2A), for example an arc of circle or parabola or hyperbola; the portion joining the flat one and the curved one corresponds to the bottom of the recess 22.

According to embodiments of the method, washing of a gas turbine engine is carried out during operation of the gas turbine engine and comprises a washing phase that consists in spraying a detergent liquid substance towards the inlet of the compressor of the engine; spraying may be carried out as shown in FIG. 1, i.e. upstream the struts and the inlet guide vanes; spraying may be carried out as shown in FIG. 1, i.e. from the mouth of the compressor.

In an embodiment, the mass flow of the detergent liquid substance to be sprayed is set so that the liquid-to-gas ratio at the inlet of the compressor is more than 1% and less than 5% with reference to the rated mass flow of the compressor. It is to be noted that, in the embodiment of FIG. 1, part of the detergent liquid substance stops against the struts and/or the inlet guide vanes and does not reach the first stage of the compressor. Thanks to the high quantity of the liquid, a good washing is achieved.

In an embodiment, the liquid-to-gas ratio is more than 1% and less than 3%, more particularly about 2%; these ratios are very good compromises between the quantity of liquid and the disturbance to the operation of the compressor and the whole gas turbine engine.

It is to be noted that the liquid-to-gas ratio is commonly referred to as WAR [Water-to-Air Ratio] as the liquid is usually water and the gas is usually air.

In an embodiment, the pressure of the detergent liquid substance to be sprayed is more than 0.2 MPa and less than 2.0 MPa (this is the pressure at the end of the conduit internal to the spraying nozzle just before spraying, i.e. with reference to FIG. 2 in the area of portion 21-2)—the pressure of the detergent liquid substance to be sprayed may be more than 0.8 MPa and less than 1.2 MPa. Thanks to the high pressure and the high speed of the liquid, a good atomization is achieved and, therefore, a good mix of liquid and gas is obtained and low disturbance to the operation of the compressor is caused and no (or very low) mechanical damages to the components of the compressor.

With reference to the exemplary embodiment of FIG. 2, the diameter of the portion 21-2 is in the range of 1.0-2.0 mm (for example 1.8 mm) the diameter of the nozzle 4 is in the range of 10-20 mm (for example 18 mm), the pressure in the portion 21-2 is in the range of 0.2-2.0 MPa (typically 0.8-1.2 MPa) and the speed in the portion 21-2 is in the range of 5-30 m/sec (for example 22 m/sec).

The combination of high liquid-to-gas ratio and high liquid pressure is synergic for achieving a good washing during operation of the engine.

Other important aspects for good performances are: the distance between the points of liquid ejection and the external wall (see e.g. elements 2 and 12 in the embodiment of FIG. 1) of the inlet path of the compressor, the distance between the points of liquid ejection and the internal wall (see e.g. elements 3 and 13 in the embodiment of FIG. 1) of the inlet path of the compressor, and the spraying direction (see e.g. element 4 in the embodiment of FIG. 1); when choosing these parameters the gas flow has to be considered. A comfortable position for spraying the liquid is front of the compressor from its mouth (see e.g. element 4 in the embodiment of FIG. 1).

Especially for "on-line" washing, a very appropriate liquid is pure water.

Figure 3:
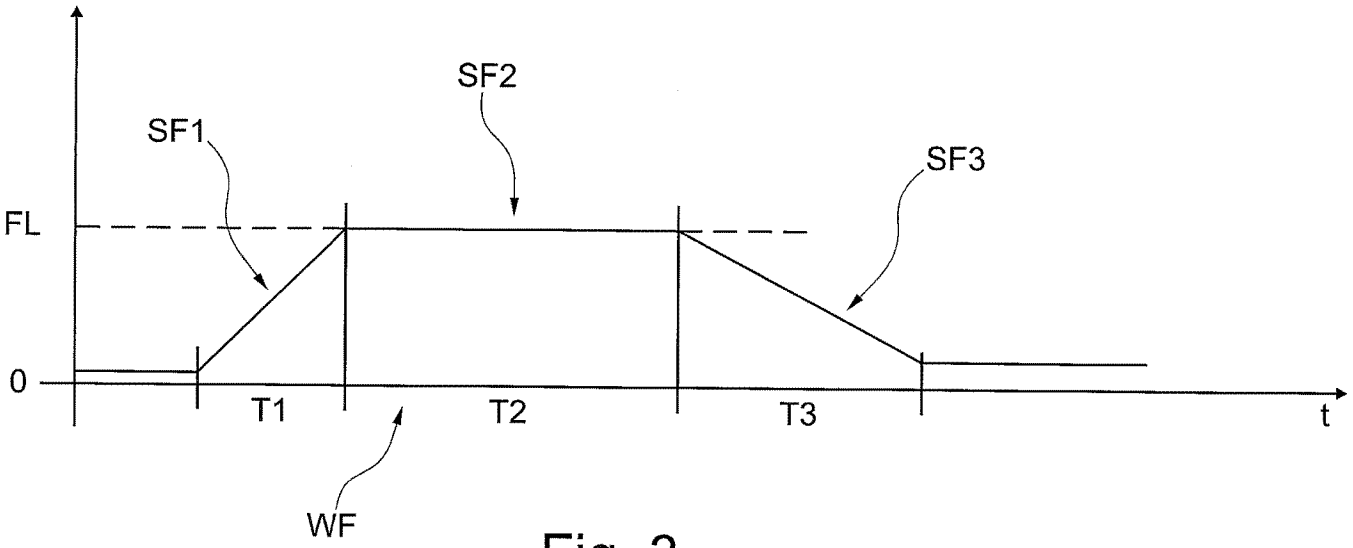
FIG. 3 shows a time diagram of an embodiment of a washing phase.

The washing phase WF shown in FIG. 3 comprises a first sub-phase SF1 during which the flow of the detergent liquid substance is increased gradually (from zero to e.g. a desired value FL), a second sub-phase SF2 during which the flow of the detergent liquid substance is maintained constant (for example at the desired value FL), and optionally, a third sub-phase SF3 during which the flow of the detergent liquid substance is decreased gradually (from the desired value FL to zero).

The gradual increase is advantageous in that the mix of fluid through the compressor varies gradually. For the same reason, the gradual decrease is advantageous even if slightly less important. Anyway, alternative washing phases are possible; for example, during the second sub-phase, the flow may not be constant and/or its flow value may depend on the operating conditions of the compressor.

The second sub-phase SF2 lasts for a predetermined period of time T2 that is more than 0.5 minutes and less than 5 minutes; may be lasting 1-2 minutes; so it is quite short. The first sub-phase SF1 lasts for a predetermined period of time T1 that is more than 5 seconds and less than 30 seconds; so it is quite long if compared to the second sub-phase SF2. The third sub-phase SF3 lasts for a predetermined period of time T3 that is more than 5 seconds and less than 30 seconds; so it is quite long if compared to the second sub-phase SF2. The first sub-phase SF1 and the third sub-phase SF3 may have the same duration.

Figure 4:
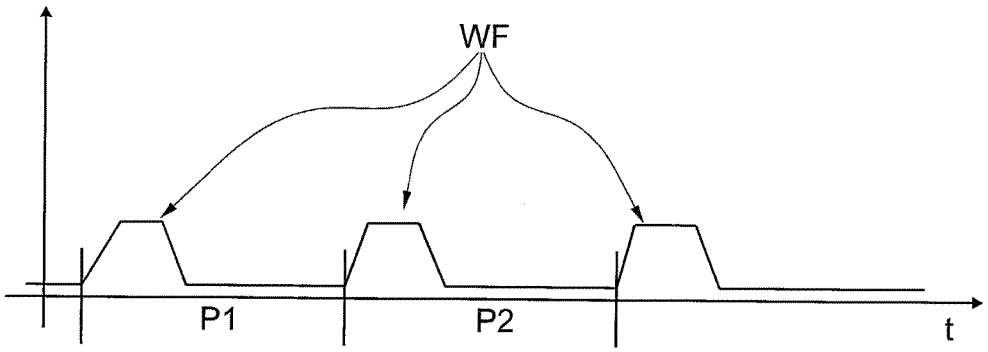
FIG. 4 shows a time diagram of a sequence of washing phases according to FIG. 3.

Very good results are achieved if the washing phase WF is repeated a number of times in a day, in particular a predetermined number of times for a predetermined time length, as it is shown in FIG. 4; in this figure, the time period between a washing phase and the following one is different (see references P1 and P2), but it may be easier to repeat it periodically. Under normal operating conditions, the number of repetition per day is selected in the range from 1 to 10 and, typically about 4.

Thanks to the above mentioned measures and with appropriate precautions, the washing phases may be carried out at any time during operation; no washing is necessary when starting and when stopping the gas turbine engine.

What has just been described, in particular the nozzle solution and the washing process solution are typically applied to a gas turbine engine, in particular to its compressor (see for example FIG. 1).

Some of the features of the washing process may be implemented through the design of the nozzle 4 in the embodiment of FIG. 1.

Some of the features of the washing process may be implemented through the control unit 19 in the embodiment of FIG. 1.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A nozzle for spraying a liquid substance towards a compressor of a gas turbine engine, the nozzle comprising:
- an elongated body having an end for ejecting the liquid substance,
- a conduit for the liquid substance internal to the elongated body and extending up to the end,
- a recess located at the end, wherein the conduit ends in the recess, and wherein a shape of a cross-section of the recess includes a partially flat portion and a partially curved portion, the partially curved portion comprising an arc of circle or parabola or hyperbola;
- wherein the recess opens towards a lateral surface of the elongated body and wherein the conduit is substantially tangential to a bottom of the recess.

2. The nozzle of claim 1, wherein the elongated body is a cylindrical body.

3. The nozzle of claim 1, wherein the recess is arranged according to a diameter direction of the elongated body.

4. The nozzle of claim 1, wherein the partially flat portion of the shape of the cross-section of the recess and the partially curved portion of the shape of the cross-section of the recess corresponds to the bottom of the recess.

5. The nozzle of claim 1, wherein the conduit has a first cross section at a first end and smaller second cross section at a second end.

6. The nozzle of claim 5, wherein the conduit has a bottleneck in a lower portion of an intermediate portion of the nozzle above the recess.

7. The nozzle of claim 2, wherein the recess is arranged according to a diameter direction of the elongated body.

8. A gas turbine engine comprising a compressor, a turbine downstream of the compressor, and a plurality of nozzles for spraying a detergent liquid substance towards an inlet of the compressor; wherein each of the plurality of nozzles is according to claim 1.

9. The gas turbine engine of claim 8, wherein the plurality of nozzles are located at a mouth of the compressor.

10. The gas turbine engine of claim 9, wherein the plurality of nozzles are located on a circle centered on an axis of the gas turbine engine.

11. The gas turbine engine of claim 10, wherein the plurality of nozzles are equi-spaced on the circle.

12. The gas turbine engine of claim 9, further comprising a manifold in fluid communication with the plurality of nozzles, wherein a manifold is located behind the mouth of the compressor.

13. The gas turbine engine of claim 8, wherein the recess opens downstream of a flow entering the compressor.

* * * * *